US006550876B2

(12) United States Patent
Lammens

(10) Patent No.: US 6,550,876 B2
(45) **Date of Patent: *Apr. 22, 2003**

(54) FILE INTERLOCK SYSTEM AND MECHANISM

(75) Inventor: Arthur E. Lammens, Fullerton, CA (US)

(73) Assignee: Accuride International, Inc., Sante Fe Springs, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/884,130

(22) Filed: Jun. 19, 2001

(65) Prior Publication Data

US 2002/0014817 A1 Feb. 7, 2002

Related U.S. Application Data

(63) Continuation of application No. 09/384,311, filed on Aug. 26, 1999, now Pat. No. 6,296,332, which is a continuation-in-part of application No. 08/951,935, filed on Oct. 16, 1997, now Pat. No. 5,988,778, which is a continuation of application No. 08/680,563, filed on Jul. 12, 1996, now abandoned.

(60) Provisional application No. 60/104,290, filed on Oct. 14, 1998.

(51) Int. Cl.[7] ..... E05B 65/46; A47B 88/04

(52) U.S. Cl. ..... 312/217; 312/334.47

(58) Field of Search ..... 312/216, 217, 312/218, 219, 221, 222, 215, 333, 334.44, 334.45, 334.46, 334.47

(56) References Cited

U.S. PATENT DOCUMENTS

| | | | | |
|---|---|---|---|---|
| 3,323,849 A | 6/1967 | Stark | ..... | 312/221 |
| 3,454,320 A | 7/1969 | Olree | ..... | 312/217 |
| 3,531,171 A | 9/1970 | Raabe et al. | ..... | 312/268 |
| 3,705,754 A | 12/1972 | Drum et al. | ..... | 312/214 |
| 3,874,755 A | 4/1975 | Hegg et al. | ..... | 312/221 |
| 3,881,793 A | 5/1975 | Anderson | ..... | 312/217 |
| 3,900,236 A | 8/1975 | Goulish et al. | ..... | 312/217 |
| 3,998,508 A | 12/1976 | Scheerhorn | ..... | 312/221 |

(List continued on next page.)

FOREIGN PATENT DOCUMENTS

| | | | | |
|---|---|---|---|---|
| CA | 2298031 | | 8/2000 | |
| CH | 186677 | * | 9/1936 | ..... 312/221 |
| DE | 4327688 | | 8/1993 | |
| EP | 669439 | | 8/1995 | |
| FR | 2173463 | | 10/1973 | |
| GB | 1471653 | | 4/1977 | |
| GB | 2095322 | | 9/1982 | |
| WO | 9406989 | | 3/1994 | |

*Primary Examiner*—James O. Hansen
(74) *Attorney, Agent, or Firm*—Christie, Parker & Hale, LLP

(57) ABSTRACT

An interlock system for use with two or more vertically arranged drawers mounted on telescopic slides in a housing such as a cabinet so as to prevent the extension of a drawer once another drawer is opened. The interlock system interfaces with the stationary members of vertically arranged slides attached to the cabinet. A pair of opposing upper and lower actuator followers are slidably and transversely fitted near the front of the stationary members so that movement of one actuator follower toward the other, displaces the other. A rod connects the upper actuator follower of one slide with the lower actuator follower of a slide directly above it. An actuator is connected to the front ends of the telescopic members of the slides. Alternatively, an actuator having pivoting or flexing fingers is connected to the front end of the intermediate members of each slide. The fingers extend beyond the front end of the telescopic member of a slide when the slide is in a fully retracted position for engaging the slide's actuator followers.

25 Claims, 12 Drawing Sheets

U.S. PATENT DOCUMENTS

| | | | | |
|---|---|---|---|---|
| 4,239,309 | A | 12/1980 | De Fouw et al. | 312/221 |
| 4,240,685 | A | 12/1980 | Terlecki | 312/217 |
| 4,272,138 | A | 6/1981 | Stark | 312/221 |
| 4,298,236 | A | 11/1981 | Laroche | 312/215 |
| 4,352,529 | A | 10/1982 | Steinke | 312/222 |
| 4,355,851 | A | 10/1982 | Slusser | 312/215 |
| 4,429,930 | A | 2/1984 | Blouin | 312/216 |
| 4,478,466 | A | 10/1984 | Clark et al. | 312/215 |
| 4,480,883 | A | 11/1984 | Young | 312/220 |
| 4,560,212 | A | * 12/1985 | Papp et al. | 312/334.47 X |
| 4,637,667 | A | 1/1987 | Reid et al. | 312/217 |
| 4,768,844 | A | 9/1988 | Ludwig | 312/221 |
| 4,936,640 | A | 6/1990 | Pratzer | 312/221 |
| 4,966,423 | A | 10/1990 | Higuera et al. | 312/221 |
| 4,971,281 | A | 11/1990 | Steinbeck | |
| 5,056,877 | A | 10/1991 | Westwinkel | 312/221 |
| 5,062,678 | A | 11/1991 | Westwinkel | 312/221 |
| 5,069,263 | A | 12/1991 | Edwards | |
| 5,074,627 | A | 12/1991 | Broeders | 312/221 |
| 5,102,210 | A | 4/1992 | Beals | 312/330.1 |
| 5,169,238 | A | 12/1992 | Schenk | 384/21 |
| 5,251,974 | A | 10/1993 | Beals | 312/330.1 |
| 5,352,030 | A | 10/1994 | Derle et al. | 312/221 |
| 5,366,283 | A | 11/1994 | Crose | 312/183 |
| 5,433,516 | A | 7/1995 | Beals et al. | 312/257.1 |
| 5,634,701 | A | 6/1997 | Hendrich et al. | 312/221 |

* cited by examiner

48

FILE INTERLOCK SYSTEM AND MECHANISM

CROSS-REFERENCE TO RELATED APPLICATIONS

The present application is a continuation application of U.S. patent application Ser. No. 09/384,311, filed on Aug. 26, 1999, and issued as U.S. Pat. No. 6,296,332, which claims priority on U.S. Provisional Application No. 60/104,290 filed on Oct. 14, 1998 and which is a continuation-in-part of U.S. patent application Ser. No. 08/951,935 filed on Oct. 16, 1997, now issued as U.S. Pat. No. 5,988,778, which is a continuation of U.S. patent application Ser. No. 08/680,563 filed on Jul. 12, 1996, now abandoned.

FIELD OF THE INVENTION

The present invention relates to an interlock system for use with multiple vertically arranged drawers or storage units mounted via telescoping slide assemblies in a unit such as a lateral drawer file cabinet. The interlock system prevents the opening of a second drawer when one drawer is open so as to prevent the tipping over of the file cabinet.

BACKGROUND OF THE INVENTION

Cabinets with multiple vertically arranged drawers may tilt over when more than one drawer is open at the same time, creating a hazard. The tilting of the cabinet is caused by the shifting of the cabinet center of gravity when two or more drawers are opened. Tilting of a cabinet is especially likely to occur when the open drawers contain relatively heavy materials.

To prevent such tilting, many cabinets with vertically arranged drawers incorporate interlock systems which prevent a drawer from being opened if another drawer is open. Some interlock systems in use today interface with the rear portion of the file drawers as is illustrated in U.S. Pat. No. 4,480,883. Their location makes their installation and repair difficult. Moreover, the position of such interlock systems make it difficult to interface these systems with locking systems which are typically located at the front of the cabinet on either side of the top portion of the file housing.

Current interlock systems require that their components be installed or removed in a sequential order. For example, interlock components positioned between the lowermost slides must be installed prior to components located between the uppermost slides. An example of this design is an interlock system utilizing a stack of latch bars which is disclosed in U.S. Pat. No. 4,637,667. Furthermore, components located proximate to the lowermost slides cannot be removed without first removing the components located proximate to the uppermost slides. This makes for a complex, time consuming, and costly interlock system installation and removal process.

In addition, most interlock system in use today are designed for use with drawers of a specific predetermined height and cannot be easily altered for use with drawers of different heights.

Most interlock systems in use today also require that their components be built to precise tolerances. A shift in these tolerances may result in interlock system malfunction.

Rotational cam interlock systems, also currently used, such as disclosed in PCT Application Serial No. PCT/CA93/00359 (International Publication No. WO94/07989) rely on instantaneous actuation upon drawer openings and may not always maintain a constant displacement while the drawer is open. Consequently, they do not provide for a positive and maintained actuation so as to prevent system malfunction. This could result in inadvertent unlocking of the drawers.

Accordingly, there is a need for an interlock system which can interface with the front of the slides used to couple the drawers to a cabinet or other housing and which can interface with the cabinet locking system. Moreover, an interlock system is needed that is easy to install, that does not require precise tolerances, and that can be easily altered for use with drawer arrangements comprising drawers of different heights.

SUMMARY OF THE INVENTION

The present invention provides a drawer slide interlock system for use with two or more vertically arranged drawers mounted on left and right sets of vertically spaced apart telescoping slides in a housing such as a file cabinet or storage unit. The interlock system may interface with either the left or right set of slides.

Each slide assembly comprises a stationary member which attaches to the cabinet and a telescoping member which attaches to the drawer.

A pair of opposing upper and lower actuator followers are slidably and perpendicularly located adjacent the front end of each stationary member. Each actuator follower may slide from a position blocking the extension path of the telescopic member to a position of not blocking such extension path. Within a slide, as one actuator follower moves toward the other, it abuts the other and displaces it. For example, as the lower actuator follower moves upward, it abuts against the upper actuator follower and displaces it.

Rods are used to interconnect the upper actuator follower of one slide to the lower actuator follower of a higher slide. The rods can easily snap in and, if necessary, snap out of the actuator followers. When connected into the actuator followers, the rods are free to move vertically within reasonable limits.

In one embodiment, an actuator is fitted on the front end of the telescopic member. The actuator has tapered surfaces. Tapered surfaces on the actuator followers come in contact with the actuator tapered surfaces as the telescoping member is extended from its closed position or when it is retracted from an open position. The actuator and actuator followers are preferably made from a polymeric material so as to reduce friction, soften the impact between them and quiet the operation of the slide.

Upon extension of a telescoping member of one slide, the actuator in front of the telescoping member makes contact with the upper actuator follower of that slide and displaces it upwards. The actuator follower is maintained upwardly displaced by the extension of the slide's intermediate member which is sequenced to initially extend with the slide telescopic member. Consequently, the actuator follower displaces the rod and the interconnected lower actuator on the immediately higher slide, bringing the lower actuator follower of that slide in position to block the extension of the telescoping member of the slide.

Simultaneously, this lower actuator follower displaces its opposing upper actuator follower. This process is simultaneously repeated and as a result, all lower actuator followers on the slides located above the extended slide move into position to block the extension of their respective telescopic members.

Similarly, the extended slide blocks the upward movement of the upper actuator followers of the lower slides.

Consequently, all the upper actuator followers of the slides below the extended slide are precluded from moving upwards, thus, remaining in a position blocking the extension of their respective telescopic members.

In an alternate embodiment, the actuator comprises a body and a pair of fingers extending beyond the actuator body. These fingers are flexible or are pivotally coupled to the actuator body. This alternate embodiment actuator is coupled to the front end of the intermediate member of a slide such that the fingers of the actuator extend beyond the slide's telescopic member when the slide is retracted. When the slide is retracted, the upper finger is in position to engage the upper actuator follower of the slide while the lower finger of the actuator is in position to engage the lower actuator follower of the slide. With this embodiment, extension of the slide telescopic member causes extension of the slide's intermediate member which is sequenced to extend with the slide's telescopic member causing the fingers and subsequently the intermediate member to engage and displace upward the slide's upper actuator follower. With this embodiment actuator, the interlock system still functions as described above. However, if the sequencing mechanism of the slide being extended fails such that the slide's telescopic member extends without extending the slide's intermediate member, the slide's telescopic member will still bias the slide's actuator upper finger upward causing it to engage and displace the slide's upper actuator follower upward. Simultaneously, the telescopic member will block the actuator lower finger and thus the lower actuator follower from displacing upward. Consequently, extension of the slides above and below the extended slide is prevented.

A locking mechanism for locking all the slides in a closed position can easily be incorporated into the interlock system of the present invention. For example, a locking mechanism can be positioned such that it interferes with the upward movement of the uppermost actuator follower of the uppermost slide. This will preclude the upward displacement of any upper actuator follower of any slide. Consequently all of the upper actuator followers will be in a position blocking the extension of their respective telescopic members.

Similarly, a locking mechanism can also be incorporated anywhere along the height of the system. For example, a member can be used to bias any of the rods such that all the lower actuator followers on the slides directly above the biasing member are displaced upward, while all the upper actuator followers of the slides directly below the biasing member are prevented from being displaced upward. Consequently, an actuator follower on a slide of each drawer will be in a position to block the extension of its respective telescopic member.

DETAILED DESCRIPTION

The present invention is an interlock system for use with two or more vertically arranged drawers mounted on telescopic slides in a housing such as a cabinet so as to prevent the extension of a drawer once another drawer has been opened.

Figure 1:
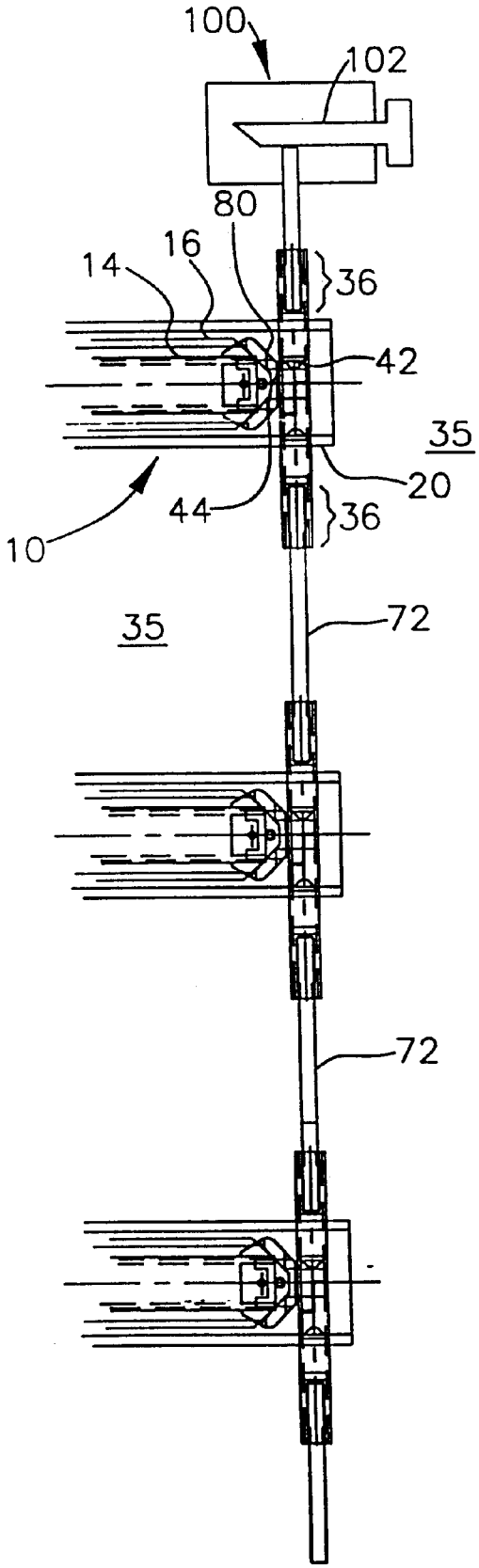
FIG. 1 is an interlock system for three vertically arranged slides with all the slides being in a fully closed position.
Figure 2:
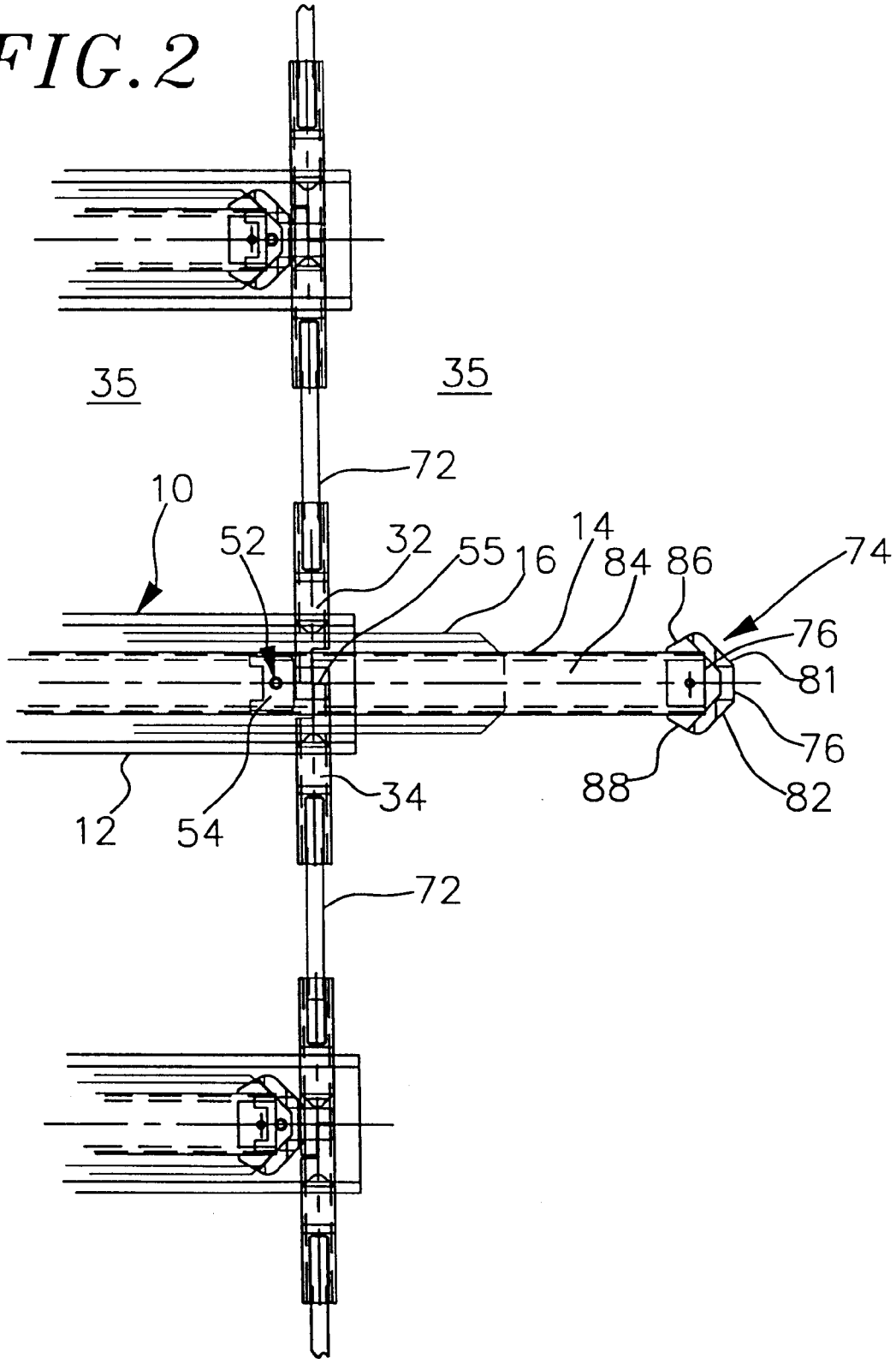
FIG. 2 depicts the interlock system shown in FIG. 1 with the center slide extended.

The interlock system interfaces with telescopic slides which are used to mount drawers into the cabinet (FIGS. 1, 2). The telescopic slides can be of various designs. For descriptive purposes, however, the present invention is described in terms of telescopic slides 10 having a channel shaped stationary member 12 which is attached to the cabinet wall 35 and a telescopic member 14 which is attached to the drawer (not shown). The telescopic member may preferably be coupled to the outer stationary-member via an intermediate member 16. For descriptive purposes, the term "telescopic member" as used herein refers to the slidable member of the slide assembly. For slide assemblies which include an intermediate member, the term "telescopic member" refers to the slide member coupled to the intermediate member of a three member slide.

Each drawer is slidably coupled to the cabinet using two slides. One slide is coupled to the left side of the drawer and the other to the right side of the drawer. Thus, a cabinet has a right and left set of slides. The interlock system may interface with either the left or the right set of slides or both.

Figure 3A:
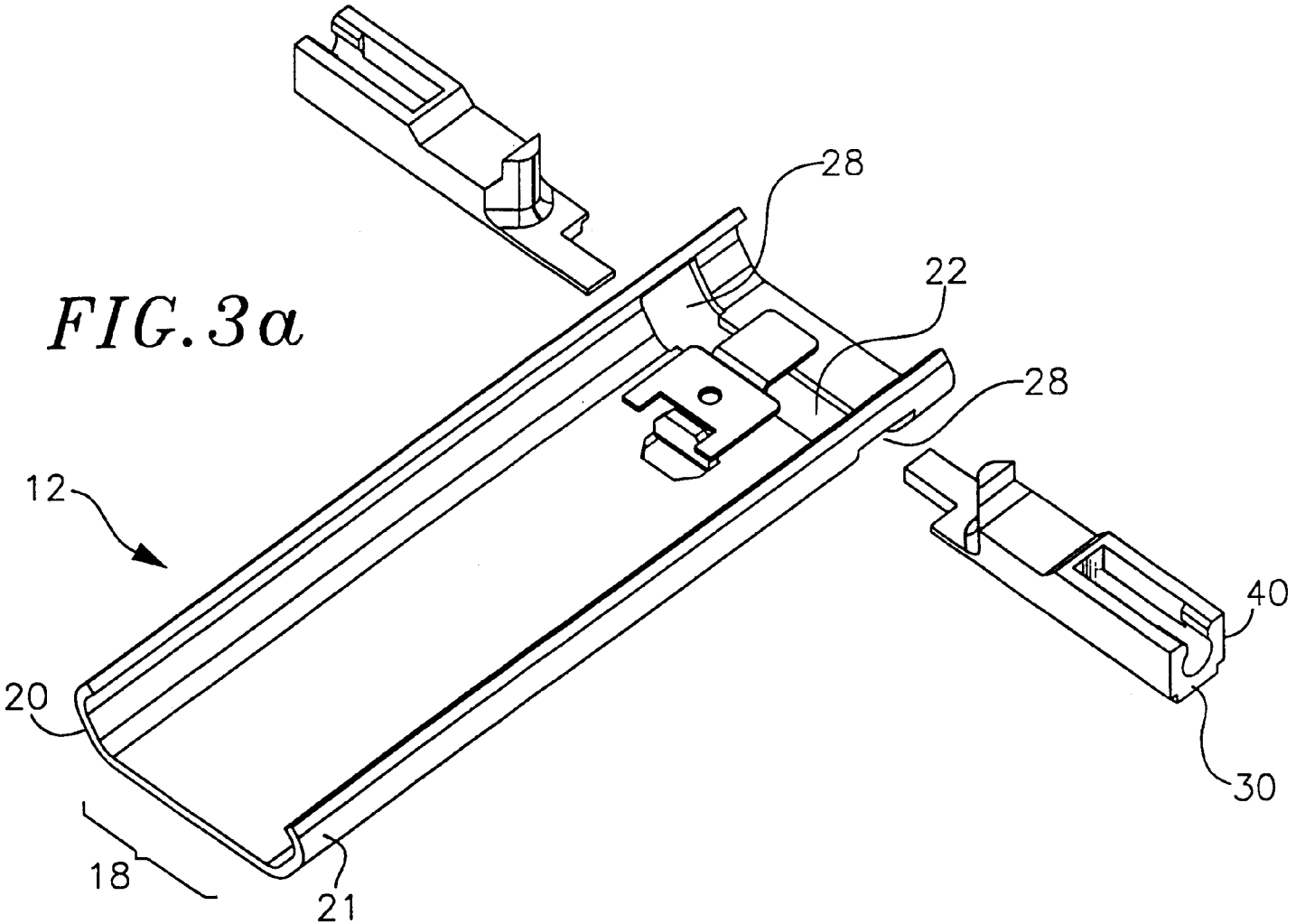
FIG. 3*a* is an isometric view of a slide stationary member showing the cutouts which allow for the slidable fitting of the actuator followers.

The stationary member 12 of each slide is channel shaped having a web section 18 from which extend lateral arcuate sections 20, 21 forming the channel (FIG. 3*a*). An elongated cutout 22 extending across the vertical section 18 is formed proximate the front end of the stationary channel. Preferably, cutout 22 is formed adjacent the front end of a stationary member and typically has a width of less than an inch.

As further illustrated in FIG. 3*a*, apertures 28 are formed in the lateral sections 20, 21 of the stationary member at opposite ends of cutout 22. These apertures are wider than the cutout 22 formed in the web section of the stationary member and together with cutout 22 form one continuous opening. All three cutouts are aligned laterally across the channel forming a continuous cutout.

Figure 3B:
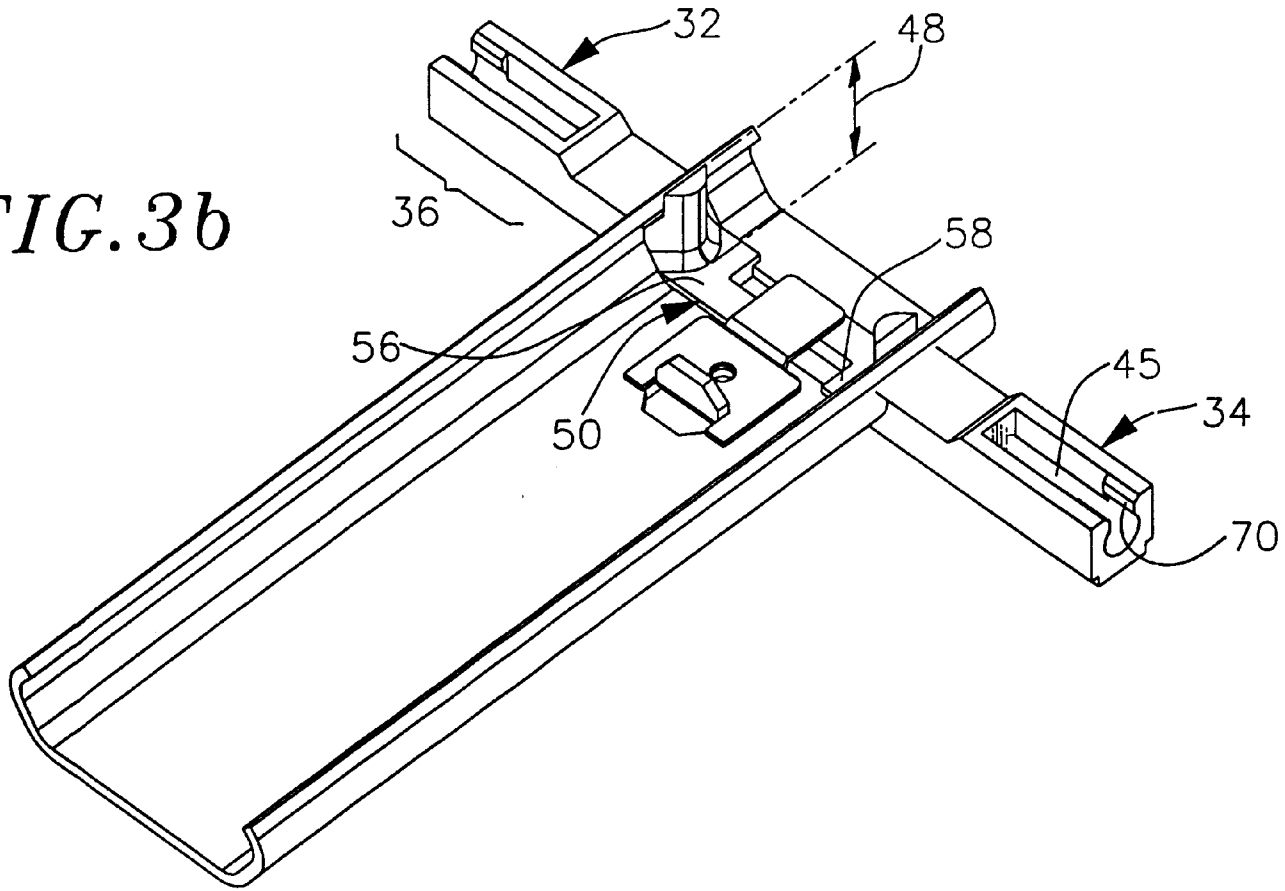
FIG. 3*b* is an isometric view of a slide stationary member with fitted upper and lower actuator followers.
Figure 3C:
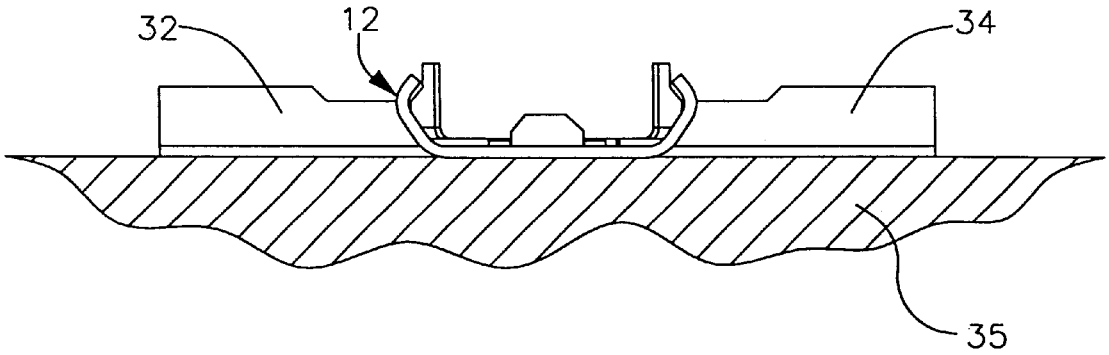
FIG. 3*c* is an end view of a stationary member with actuator followers mounted on a cabinet wall.

Opposed upper and lower actuator followers 32, 34 are slidably fitted within these cutouts (FIGS. 2, 3*a*, 3*b*). The upper actuator follower 32 is slidably fitted through the cutout formed on the upper lateral section of the stationary member. Similarly, the lower actuator 34 follower is fitted through the cutout formed on the lower lateral section (FIGS. 1, 2, 3*b*). The actuator followers normally are fitted within the cutouts prior to attachment of the stationary member of the slide to cabinet wall 35 (FIG. 3*c*). When fitted within the cutouts, a portion of each actuator follower extends outside of the stationary member beyond the lateral sections. For descriptive purposes, the portion 36 of the actuator follower that always extends beyond the lateral section is referred herein as the "external portion" of the actuator follower (FIG. 1).

Figure 4C:
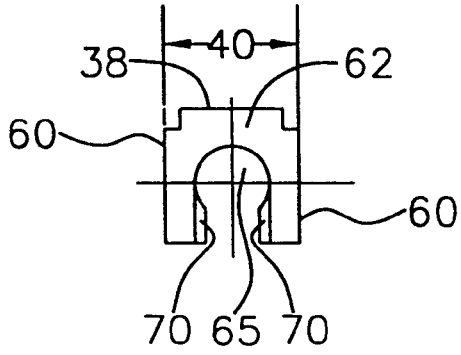
FIG. 4*c* is a top view of an actuator follower.
Figure 4A:
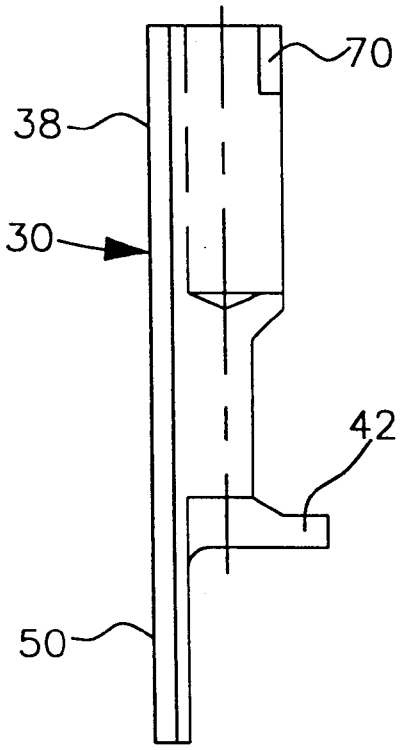
FIG. 4*a* is a side view of an actuator follower.

The rear surface 38 of the actuator follower is stepped down in width (FIGS. 4*a* and 4*c*). This stepped-down portion allows the rear surface of the actuator to fit and slide within the vertical cutout on the vertical section of the stationary member. The wider portion 40 of the actuator follower is designed to fit and slide within the cutouts 28 formed in the lateral sections of the stationary member. The narrower portion of the actuator follower serves as a guide for guiding the stepped down back portion of the actuator follower and thereby, guiding the sliding motion of the actuator follower.

Figure 4B:
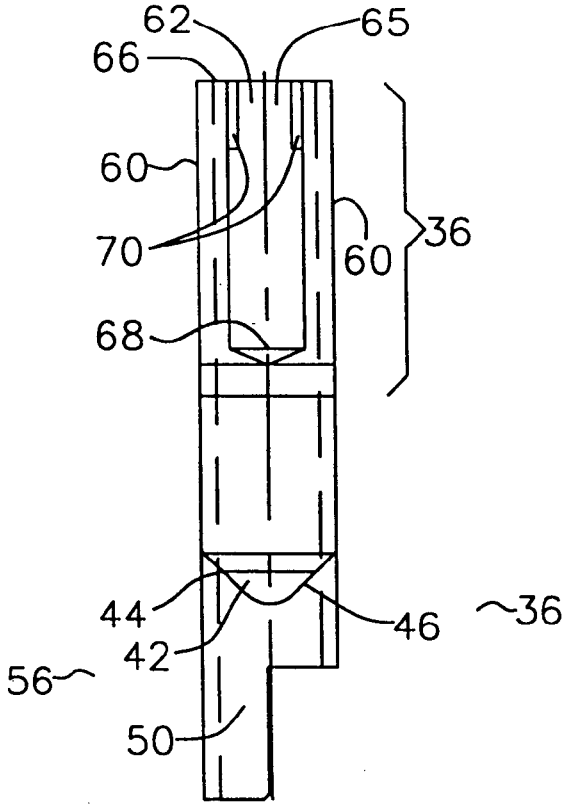
FIG. 4*b* is a front view of an actuator follower.

Each actuator follower has a laterally projecting member or tip 42 which typically has a triangular or trapezoidal cross-sectional geometry with a rounded apex (FIGS. 4*a*, 4*b*). The inclined surfaces 44, 46 of the tip are preferably at 45°. Once an actuator follower is slidably fitted within the stationary member, its tip is located between the two lateral sections 20, 21 of the stationary member. Moreover, the tip has a length 48 such that it projects beyond the cutout on the lateral section of the stationary member. As a result, once the follower is inserted into the aperture, the tip prevents the actuator follower from sliding beyond a lateral section of the stationary member (FIGS. 3*b*, 3*c*).

A vertical projection 50 extends perpendicularly beyond the conical surface as part of the back side 38 of the actuator follower (FIGS. 4*a*, 4*b*). The vertical projections from the two opposing actuator followers are designed to abut against each other when one actuator follower slides toward the other (FIGS. 1 and 2). Therefore, as one actuator follower moves toward the other, it displaces the other actuator follower.

Figure 5A:
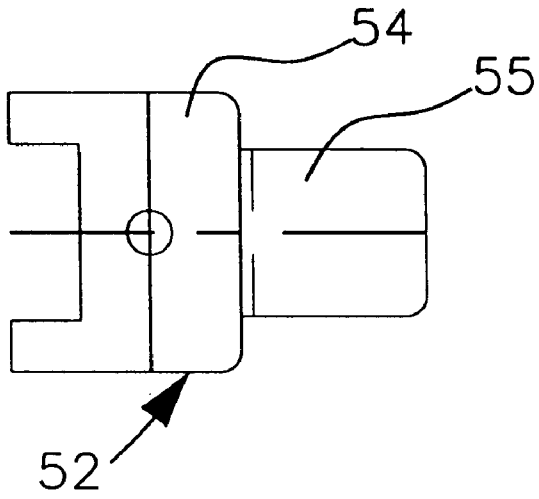
FIG. 5*a* is a top view of a retention clip.
Figure 5B:
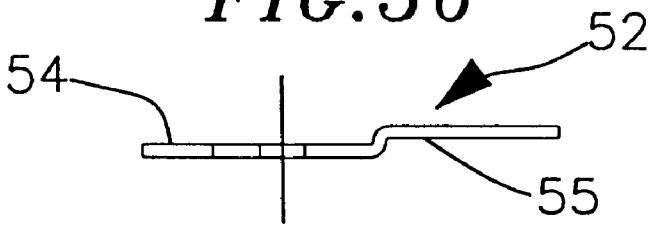
FIG. 5*b* is a side view of a retention clip.
Figure 6:
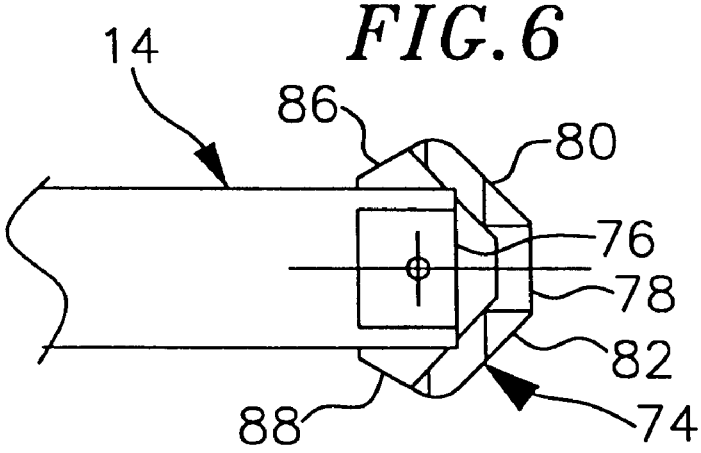
FIG. 6 depicts the actuator mated to the front end of the telescopic member.

An actuator follower retention clip 52 may be used to retain the actuator followers within the stationary member of the slide (FIGS. 5*a*, 5*b*). The retention clip is typically a metallic or plastic strip that is shaped to form two sections offset from each other in parallel. One section 54 of the clip is fixed or fastened to the stationary member such that the other offset section 55 defines a space through the vertical cutout 22 between itself and the cabinet surface upon which the stationary member is mounted. The projections of the actuator followers slide within that space (FIGS. 1, 2, 3*a*, 3*b*, 5*a*, 5*b*).

To ensure that an actuator follower is always retained by the retention clip, i.e., to ensure that a vertical projection of an actuator follower does not slide beyond the area covered by the retention clip, the vertical projection 50 is stepped along its width. For half of its width the projection has a longer length 56 than it does for the other half of its width. The stepped projections of opposing actuator followers are complimentary to each other (FIGS. 1, 2).

The external portion 36 of the actuator follower has a depth which is greater than the length of the cutout 28 on the lateral sections of the stationary member. This prevents the external portion from sliding through the lateral sections. The external portion forms an internal vertical channel 65. The channel is formed by two sidewalls 60 connected by a lateral wall 62. The lateral wall 62 is part of the back surface of the actuator follower (FIGS. 4*b*, 4*c*). The channel's upper end 66 is open while its bottom end 68 is bounded by the lower portion of the actuator follower. A small lip 70 is formed on the inner surface of each sidewall. The lip spans only a portion of the inner surface of each sidewall, both longitudinally and laterally, beginning from the horizontal and lateral edges of the sidewall.

Rods 72 are used to interconnect the actuator followers of adjacent slides (FIGS. 1, 2). For example a rod connects the upper actuator follower 32 of one slide to the lower actuator follower 34 of the slide directly above it. The rods used may have any cross-sectional shape. For descriptive purposes however, reference is being made herein to cylindrical rods.

The rods are inserted into the channel opening of the external portions of the actuator followers. The rods are inserted by pushing them past the lips 70 on the inner surfaces of the sidewalls. The rods pass the lips and "snap" in place. The lips serve as retainers to maintain the rods within the channel opening. The rods can also be easily removed, if necessary, by pulling them ("snapping" them) out past the lips. When inserted into the vertical channel openings, it is preferred that the rods are able to freely slide within the channel openings.

An actuator 74 is attached to the front of the slide telescopic member. When attached, the actuator surrounds the front end 76 of the telescopic member 84 (FIG. 2). The actuator has flat face 78 parallel to the end of the telescopic member end. Two inclined surfaces 80,82 extend toward the telescopic member end from the upper and lower ends of the flat face. Preferably, the surfaces are symmetric about the telescopic member longitudinal axis 84. These surfaces are referred to herein as the front inclined surfaces. These surfaces continue past the vertical plane of the end of the telescopic member and then gradually bend by approximately 90° toward the upper and lower edges of the telescopic member forming another set of angled surfaces 86,88 (referred to herein as the "rear inclined surfaces") relative to the slide longitudinal axis. Although it is preferred that the front and rear inclined surfaces are inclined at 45°, they can be inclined at other angles.

The inclined surfaces of the tips of the actuator followers ride on the inclined surfaces of the actuator. Therefore, it is preferred that the inclination of the surfaces of the actuator match the inclination of the contacting surfaces on the conical projections.

When the actuator followers are in their fully extended position i.e., when their conical projections abut against the lateral sections of the stationary member, they do not interfere with the extension path of the telescopic member. When the distance between the apexes of the tips 42 is less than the widest section of the actuator, the projections will present a block to the extension path of the actuator and thereby the telescopic member unless they are able to be displaced away from the path of the telescopic member when the telescopic member is extended. In one embodiment, each actuator follower is allowed to slide approximately ½ inch from its extended position.

Figure 3D:
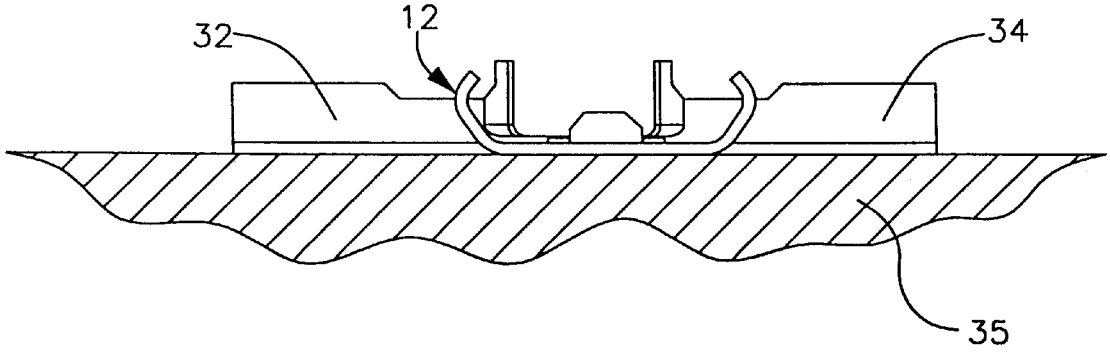
FIG. 3*d* is an end view of a stationary member with one actuator follower displacing the other.

When the telescopic member is in a closed position (FIG. 1), the tips 42 of the lower actuator follower rest under the influence of gravity, fully extended against the bottom lateral section 20 of the stationary member 12 of the slide, while the upper actuator follower, also due to gravity, is in its fully closed position with its conical projection blocking the extension path of the telescopic member 14 (FIGS. 1, 2). If all the telescopic members in a cabinet are closed and the telescopic member of one slide is extended from its closed position, the upper front inclined surface 80 of the actuator contacts the preferably matched tapered surface 44 of the tip of the upper actuator follower causing the actuator follower to be displaced upward (FIGS. 1 and 4*b*). Consequently, the actuator follower pushes on the rod 72 interconnecting it with the lower actuator follower of the slide directly above it and bringing such lower actuator follower's conical projection in the extension path of its telescopic member. Simultaneously, the vertical step-shaped projection 50 (FIGS. 3*d*, 4*b*) of the lower actuator abuts against the vertical step-shaped projection of its opposing upper actuator displacing the upper actuator. Similarly, all actuator followers of the slides located above the extended slide move the same way. Consequently, the tips of the lower actuator followers on all of the slides above the extended slide block and prevent the extension of their respective slide's telescopic members. Similarly, the extended slide blocks the upward movement of the upper actuator followers of the lower slides, i.e., the slides below it. Therefore, the tips of the upper actuators of the slides below the extended slide block and prevent the extension of those slides' telescopic members.

Since the rods can slide within the channel openings of the actuator followers and since the actuator followers travel from their extended to their closed position is relatively significant (e.g., ½ inch for the preferred embodiment), with blocking occurring within the first ⅛ inch of travel, it would be appreciated that the tolerances of the rod lengths do not have to be precise for the interlock system to properly function.

Figure 7:
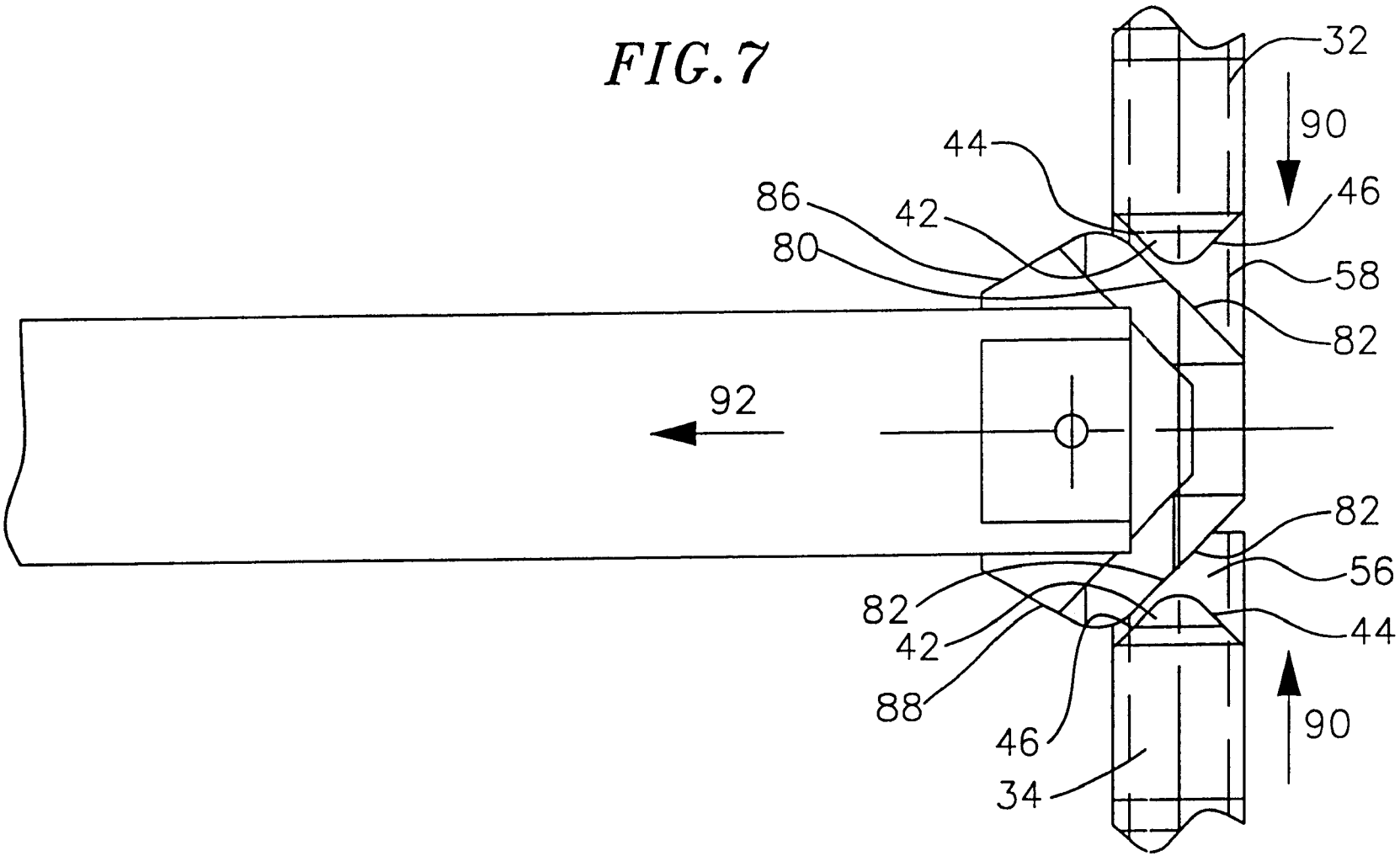
FIG. 7 depicts contact made by the actuator followers on the actuator so as to force the actuator and its telescopic member to a closed position.

If a drawer, and thereby a slide, is partially opened so that a front inclined surface 80,82 of the slide's actuator is in contact with any of the conical projections of the actuator followers, while another slide is being opened, the closing or compressing movement 90 of the actuator followers 32,34 will cause their surfaces 44,46 to bear on the front inclined surfaces 80,82 of the actuator generating a force along the axis of the telescopic member causing the actuator and telescopic member to move in a direction 92 backward to a closed position (FIG. 7). Moreover, as the telescopic member of the slide moves toward the closed position (FIG. 7) after being extended, the rear inclined surfaces 86,88 of the actuator will contact the tapered surfaces 44, 46 of the conical projection and cause them to extend so as to allow the telescopic member to close (FIG. 2). To soften the impact of the actuator with the actuator follower and to quiet operation, the actuator and actuator followers are preferably made from a polymeric material.

This interlock system can also easily be provided with a locking capability by interfacing with a separate locking system or mechanism. For example, a locking system 100 may comprise a member 102 which blocks the upward displacement of the actuator followers, thereby preventing any of the slide members from opening, as shown in FIG. 1. This can be accomplished by using a lock member which can slide in front of the travel path of a rod connected to the upper actuator follower of the uppermost slide member.

Figure 8:
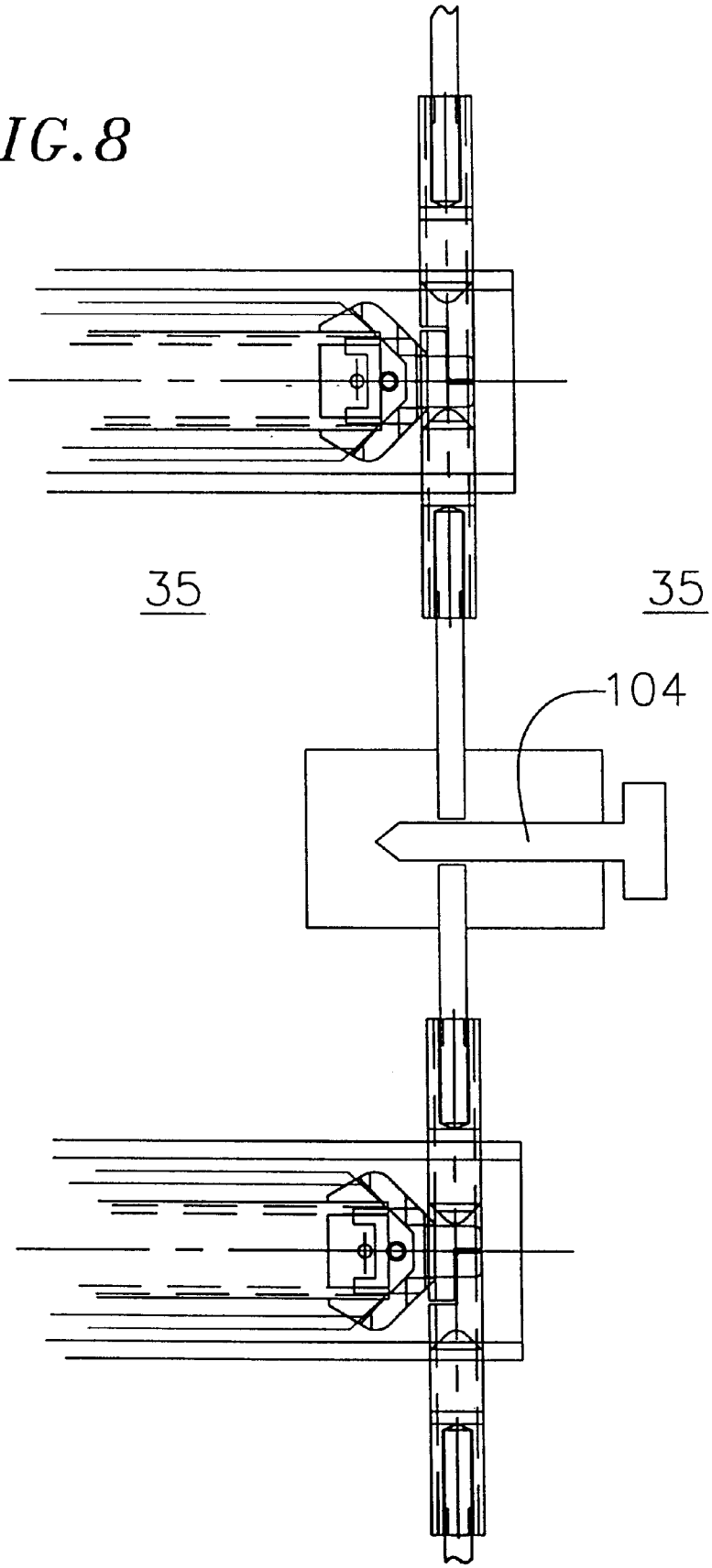
FIG. 8 depicts a lock member biasing an intermediate rod for the purpose of locking the slides.

The locking mechanism can be located at any location along the interlock system. For example, as shown in FIG. 8, a lock or biasing member can be used to bias any of the rods such that all the lower actuator followers on the slides directly above the biasing member are displaced upward, while all the upper actuator followers of the slides directly below the biasing member 104 are prevented from being displaced upward. Consequently, all actuator followers will be in a position blocking the extension of their respective telescopic members.

Typically slide assemblies incorporating a stationary member, an intermediate member and an telescopic member have a sequencing mechanism such as described in U.S. Pat. No. 5,551,775 incorporated herein by reference and in application Ser. No. 08/796,055 having a filing date of Feb. 7, 1997, and issued as U.S. Pat. No. 5,757,109, also incorporated herein by reference. As an extending force is applied to extend the telescopic member, e.g., when a drawer is opened, the sequencing mechanism temporarily prevents the telescopic member from extending relative to the intermediate member, i.e., it temporarily retains the telescopic member within the intermediate member. As a result, the extension force causes the intermediate member with its retained telescopic member to extend relative to the stationary member. When the intermediate member is extended beyond a predetermined distance, the sequencing mechanism releases the telescopic member from the intermediate member and the extending force now causes the telescopic member to extend relative to the intermediate member and the stationary member.

When a compressive force is applied to the slide assembly, as for example, when a drawer is closed, the force causes the telescopic member to slide relative to the intermediate member until the telescopic member contacts a stop on the intermediate member. The intermediate member remains extended until the telescopic member is completed retracted relative to the intermediate member. When that occurs, the force causes the intermediate member with the retracted telescopic member to retract relative to the stationary member until the intermediate member contacts a stop on the stationary member.

Hence, under normal conditions, opening of a drawer causes the intermediate member to extend relative to the stationary member prior to the extension of the telescopic member relative to the intermediate member. Moreover, during closing of a drawer, the telescopic member retracts completely relative to the intermediate member before the intermediate member retracts relative to the stationary member. With a slide incorporating an intermediate member, the actuator should have a width approximately equal to the outer width of its corresponding intermediate slide member. In this regard the actuator displaces its corresponding upper actuator follower upward to allow the slide intermediate member to move past the upper actuator follower. Thus, upon extension of the drawer, the intermediate member blocks the upward movement of its corresponding lower follower, as well as the downward movement of its corresponding upper follower. Consequently, all the upper actuator followers of the slides below the extended slide are precluded from moving upwards, thus, remaining in a position blocking the extension of their respective intermediate members. Similarly all the lower actuator followers on the slides above the extended slide are precluded from moving downward, thus, blocking the extension of the their respective intermediate members. During retraction, the intermediate member continuously causes the blocking of the movement of the upper and lower actuator followers of the lower and upper slides, respectively, until it is completely retracted.

Figure 9:
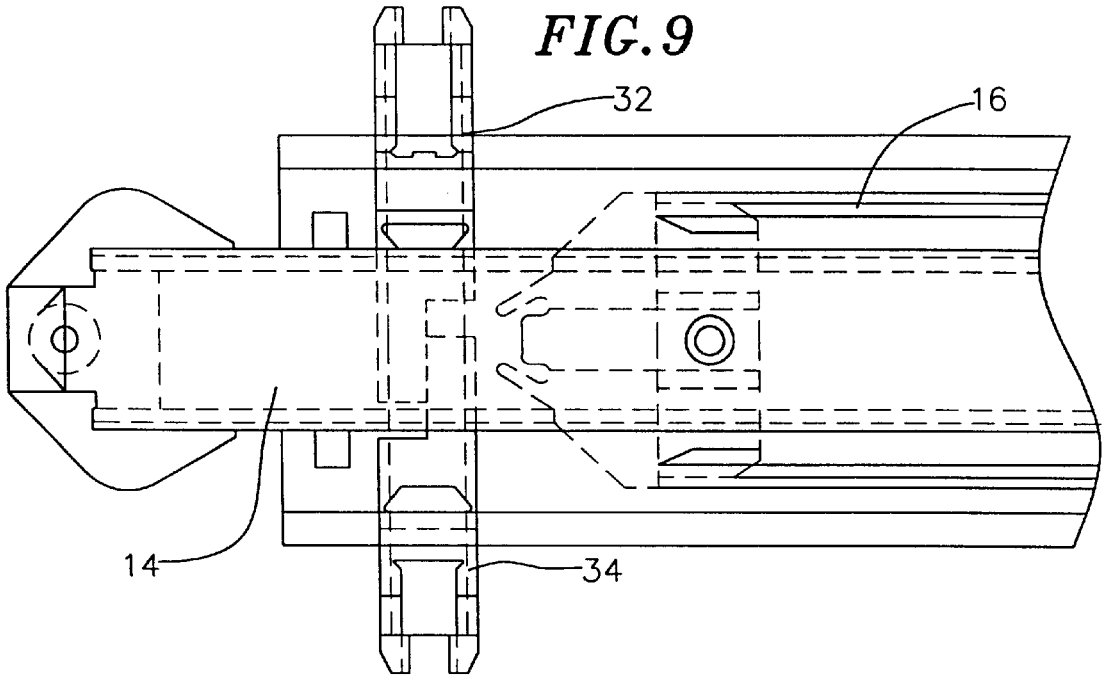
FIG. 9 depicts a three member slide with only the telescopic slide member extended.

However, if the sequencing mechanism of a slide were to fail to operate during extension of a drawer, the telescopic member may be extended relative to the intermediate member before the intermediate member is extended relative to the stationary member. If this were to occur, the upper actuator of the slide will be displaced upward by the slide's telescopic member 14 (FIG. 9). Typically, the telescopic member, because of its smaller vertical dimension, will displace the upper follower about half of the vertical distance that the follower would have been displaced by the intermediate member. Consequently, this reduction of the follower displacement travel may allow for sufficient follower displacement in a second slide allowing for the partial extension of the second slide and its associated drawer. As a result, two drawers may be partially opened at a time, with the drawer having the malfunctioning slide being partially (typically about half way) open. A similar problem may occur if the intermediate member retracted first during the closing of a drawer leaving only the telescopic member of the slide assembly extended. In both cases the anti-tip, i.e., the locking function, of the interlock system may be defeated.

Figure 11:
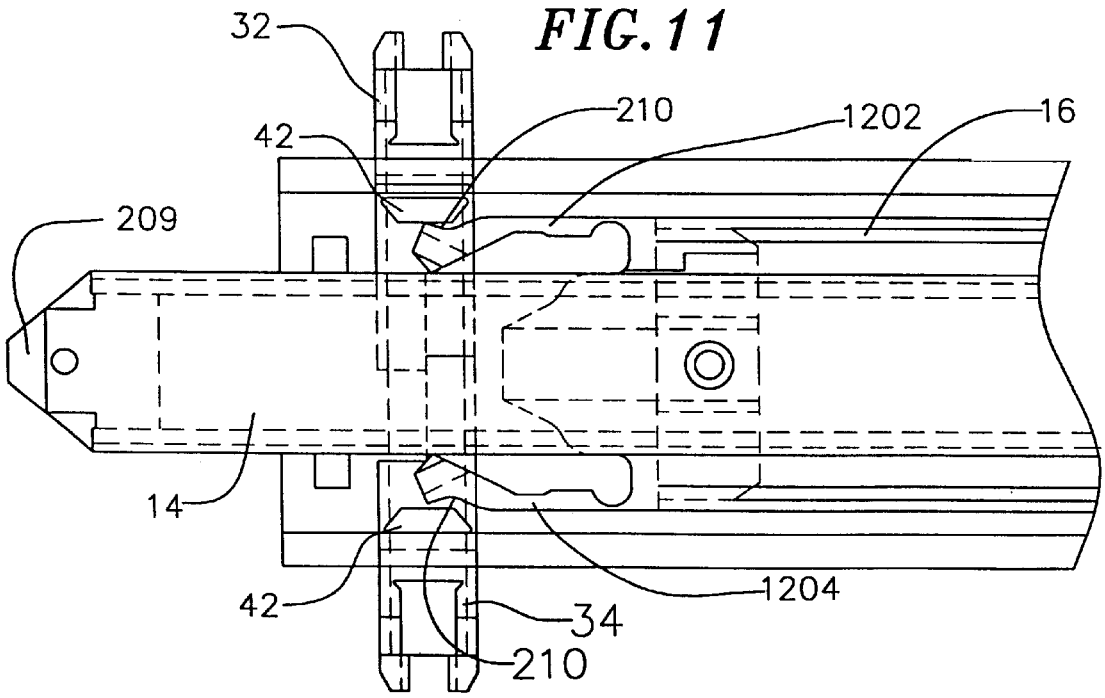
FIG. 11 depicts a three member slide with only the telescopic slide member extended and incorporating a flexible finger alternate embodiment actuator of the present invention mounted to the front end of the slide intermediate member.
Figure 10:
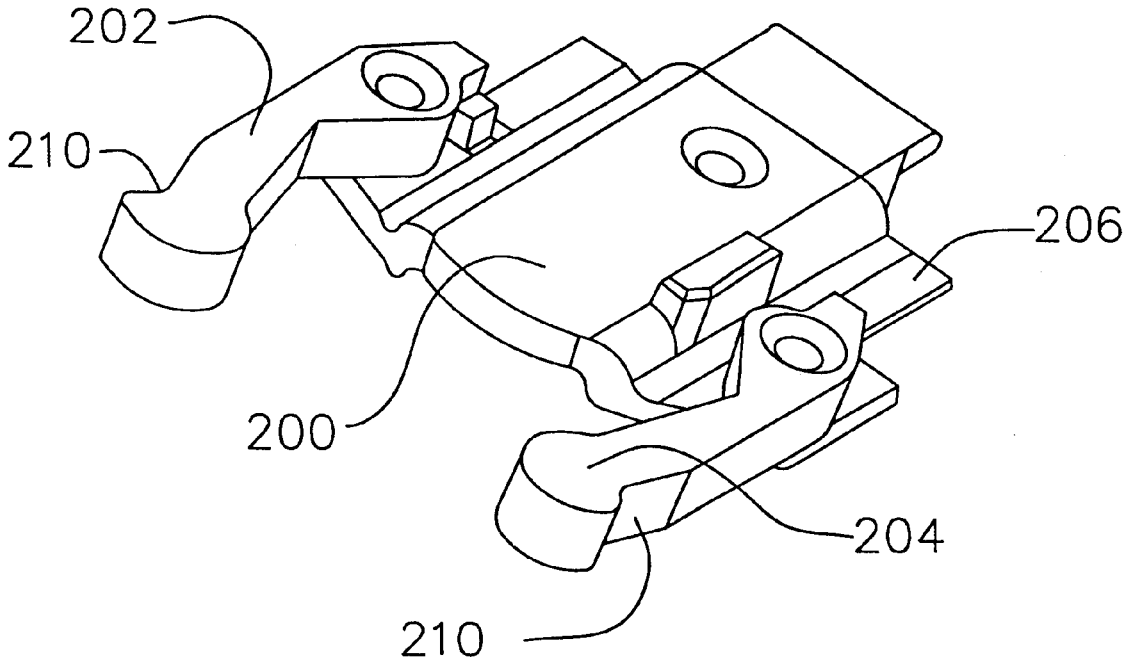
FIG. 10 depicts a perspective view of an alternate embodiment cam actuator.

To overcome this problem, an alternate embodiment actuator is provided that is coupled to the front end of the intermediate member. The actuator has a body 200 and two fingers 202, 204 extending from the forward end of the body (FIG. 10). One finger 202 extends from an upper portion of the actuator body while the other finger 204 extends from a lower portion of the actuator body. The fingers 202, 204 are separate structures that are pivotally connected to the actuator body as shown in FIG. 10. Alternatively, the fingers 1202, 1204 may be integral with the body as shown in FIG. 11. In such case, the fingers must be flexible so that they can deflect upward or downward relative to the body. The body of the actuator has a portion 206 extending from the end of the body opposite the fingers (FIG. 10). This body portion is complementary to the inner surfaces of the intermediate member for interlockingly mating with the front end portion of the intermediate member, allowing for easy mounting of the actuator to the front end of the intermediate member.

Figure 12A:
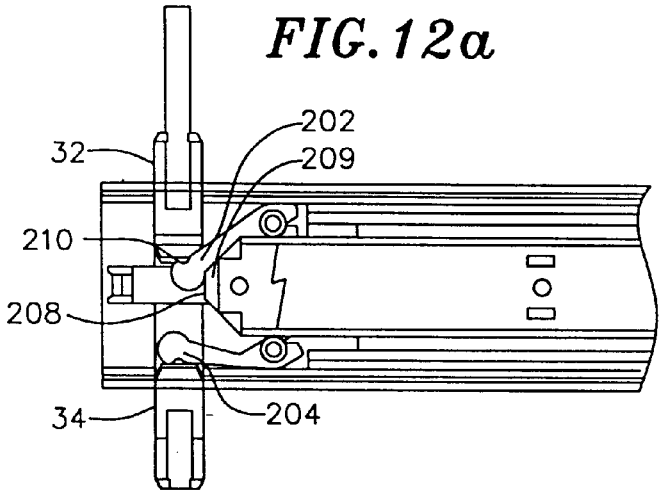
FIG. 12*a* depicts a side view of three member slide in a fully retracted position and incorporating a pivoting finger alternate embodiment actuator of the present invention mounted on the front end of the slide intermediate member.

When the slide is in a completely retracted position and the actuator is mounted in position on the front end of the intermediate member, the fingers extend beyond the front end 208 of the telescopic member to a position for engaging the followers 32, 34 (FIG. 12*a*). Under normal operating sequenced conditions, the fingers serve as the cam surface for displacing the followers as the intermediate member is extended. Each of the followers of a slide will contact a respective finger as the follower is displaced toward the slide. Preferably the surface of each finger that contacts the follower has a concavity 210 for mating with a follower tip 42 (FIGS. 10 and 11).

As a lower follower in a retracted first slide is vertically displaced upward by the extension of a drawer extending a second slide located below the first slide, the lower follower pushes on the lower actuator finger causing the lower finger to rotate or deflect upward toward the extension path of the telescopic member of the first slide, blocking the extension path of the first slide telescopic member. When in that position, the displaced lower follower also blocks the extension path of the slide intermediate member. Consequently, extension of the first slide intermediate and telescopic members is prevented thus, preventing extension of the drawer coupled to the first slide.

Similarly, the upper follower of a third slide located below the extended second slide is retained in a downward displaced position pushing the upper finger of the third slide actuator downward and into the path of the third slide telescopic member preventing its extension.

Figure 12B:
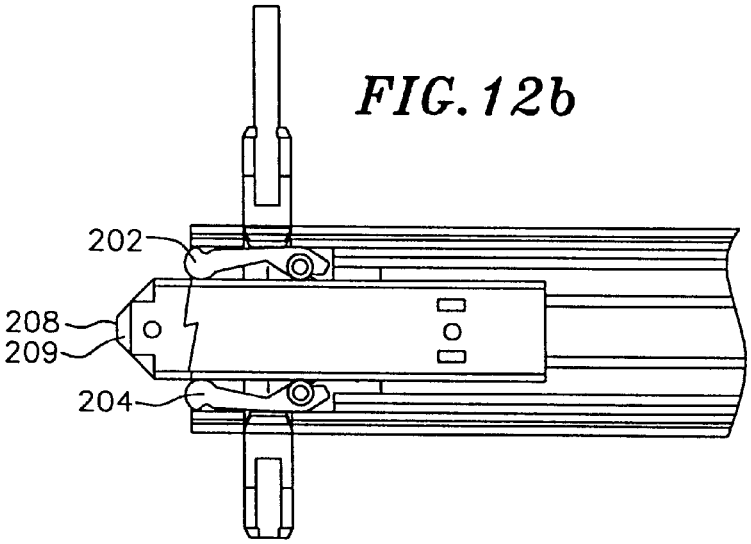
FIG. 12*b* depicts a side view of the three member slide shown in FIG. 12 with the telescopic member extended and the intermediate member partially extended.
Figure 12C:
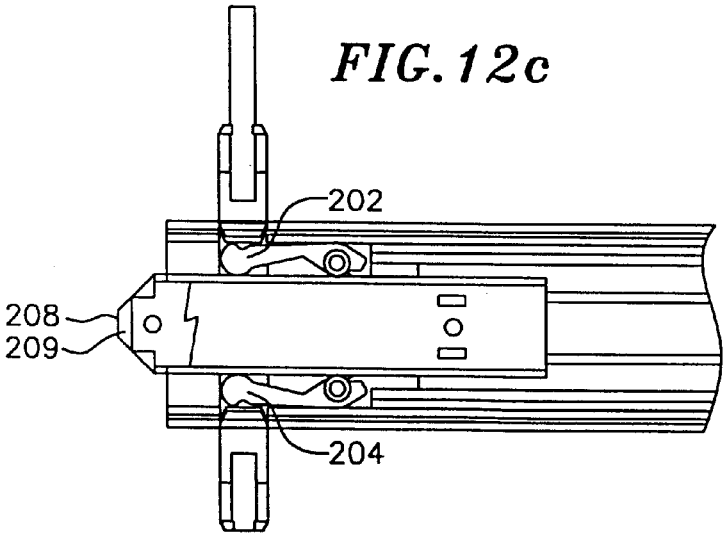
FIG. 12*c* depicts a side view of a three member slide shown in FIG. 12*a* with only the telescopic member extended.

If during the opening of a drawer, the intermediate member of the drawer slide remains fully retracted (FIGS. 11 and 12*c*), or almost fully retracted so as to be out of the displacement path of the followers (FIG. 12*b*), while the telescopic member of the slide is extended as in the case of sequencing mechanism failure or in the case of complete or almost complete intermediate member retraction prior to complete retraction of the telescopic member, the telescopic member biases the two fingers of its corresponding actuator as shown in FIGS. 11, 12*b* and 12*c*. To assist the telescopic member in biasing the two fingers, a secondary actuator 209 may be attached to the front end of the telescopic member as shown in FIGS. 11 and 12*a*–12C. Consequently, when extended, the telescopic member prevents the rotation or deflection of the fingers toward the telescopic member. When at this position, the upper finger in combination with the telescopic member of the extended slide holds the upper follower in a vertically displaced position similar or identical to the displaced position the follower would have acquired had it been displaced by the intermediate member. Simultaneously, the travel path of the lower follower of the extended slide is blocked limiting the upward travel of the lower follower to the same or almost the same vertical location that extension of the intermediate member would have limited the travel of the lower follower. In this regard, even when only the telescopic member of a slide is extended, the upper follower of that slide will be displaced sufficiently causing the lower followers of the upper slides, i.e., of the slides located above the extended slide, to have rotated their corresponding lower actuator fingers to a position blocking the extension of the telescopic and intermediate members of those slides. Similarly, the extended telescopic member in combination with its corresponding lower finger will limit the extended slide lower follower travel preventing the upward travel of the upper followers of the lower slides, i.e., of the slides located below the extended slide. Consequently, the upper actuator fingers of the lower slides are retained in a position blocking the extension of the lower slides.

The art the interlock system of the present invention can operate without an upper actuator follower and/or upper actuator finger incorporated in the uppermost slide, and likewise, without a lower actuator follower and/or lower actuator finger incorporated into the outermost slide.

The interlock system as described herein has several advantages. The interlock system of the present invention allows for modular construction. It can be used in cabinet having drawers of different heights. All that is required to accommodate the different height drawers is to use interconnect rods of appropriate length. All other required hardware remains the same. Another advantage is that the inventory costs associated with the interlock system of the present invention are reduced since only the length of the rods changes from system to system. Moreover, installation labor is reduced, since the assemblers need no longer build the interlock system by installing slides from the bottom of the cabinet upward as is required with most current interlock systems. The assemblers can install the rods in any order most convenient to them. In addition, since the locking mechanisms (actuator followers and interconnecting rods)

maintain the actuating displacement while the drawer is open, there is virtually no chance that the system would malfunction and allow additional drawers to be fully opened, or inadvertently lock all drawers.

Although this invention has been described in certain specific embodiments, many additional modifications and variations will be apparent to those skilled in the art. It is therefore, to be understood that within the scope of the appended claims, this invention may be practiced otherwise than as specifically described. For example, when adjacent drawers are narrow and their respective slides are close together, the actuator followers may be fitted together or abutted so as not to require use of a connecting rod.

What is claimed is:

1. A slide member comprising:

a first leg portion, a second leg portion and a web there between defining a channel in cross-section for receiving another slide member within a space defined between the first and second leg portions, wherein each leg portion has a first end opposite a second end; and a finger coupled to the slide member and extending beyond the first end of the first leg portion, wherein the finger can pivot relative to the web from a location extending into the space to a location external of said space.

2. A slide member as recited in claim 1 wherein the finger extends from a body coupled to the slide member.

3. A slide member as recited in claim 2 wherein the finger is integral with the body and can flex relative to the body for pivoting relative to the web.

4. A slide member as recited in claim 2 wherein the finger is pivotally coupled to the body.

5. A slide member as recited in claim 1 further comprising another finger coupled to the slide member and extending beyond the first end of the second leg portion, wherein said another finger can pivot relative to the web.

6. A slide member as recited in claim 5 wherein said finger and said another finger are spaced apart from each other and wherein said finger is proximate the first leg portion and wherein said another finger is proximate the second leg portion.

7. A slide member as recited in claim 6 wherein said finger and said another finger extend from a body coupled to the slide member.

8. A slide member as recited in claim 7 wherein said finger and said another finger are integral with the body and can flex relative to the body for pivoting relative to the web.

9. A slide member as recited in claim 7 wherein said finger and said another finger are pivotally coupled to the body.

10. A slide assembly comprising:

a first slide member having a first end opposite a second end;

a second slide member, slidably coupled to the first slide member, the second slide member being extendible along a path from the first end of the first slide member between a first non-extended position and a second extended position relative to the first slide member; and a first finger coupled to the first slide member, the first finger extending beyond the first end of the first slide member when the second slide member is in the first position, wherein said first finger pivots relative to the first slide member for blocking the path when the second member is in the first position.

11. A slide assembly as recited in claim 10, further comprising a second finger coupled to the first slide member and extending axially beyond the first end of the second slide member when the second slide member is in the first position and spaced apart from the first finger, wherein the second finger can pivot relative the first slide member for blocking the path when the second slide member is in the first position.

12. A slide assembly as recited in claim 10 wherein the first finger is external of the second slide member.

13. A slide assembly comprising:

a first slide member having a first end and a second end;

a second slide member slidably coupled to the first slide member, the second slide, the second slide member being extendible along a path from the first end of the first slide member between a first non-extended position and a second extended position relative to the first slide member;

an actuator coupled to a first end portion of the first slide member, the actuator comprising a first finger extending beyond the first end of the first slide member when the second slide member is in the first position, wherein said first finger pivots relative to the first slide member for blocking the path when the second member is in the first position.

14. A slide assembly as recited in claim 13 wherein the actuator further comprises a body wherein said finger is pivotally coupled to the body.

15. A slide assembly as recited in claim 14 wherein said finger is integral with said body, and wherein said finger can flex.

16. A slide assembly as recited in claim 13, wherein the actuator further comprises a second finger extending axially beyond the first end of the second slide member when the second slide member is in the first position and spaced apart from the first finger wherein the second finger can pivot relative the first slide member for blocking the path when the second slide member is in the first position.

17. A slide member comprising:

a first leg portion, a second leg portion and a web there between defining a channel in cross-section, wherein each leg portion has a first end opposite a second end; and a finger extending from a body coupled to the slide member and extending beyond the first end of the first leg portion, wherein the finger is integral with the body and can flex relative to the body for pivoting relative to the web.

18. A slide member comprising:

a first leg portion, a second leg portion and a web there between defining a channel in cross-section, wherein each leg portion has a first end opposite a second end; and a finger coupled to the slide member and extending beyond the first end of the first leg portion, wherein the finger can pivot relative to the web; and another finger coupled to the slide member and extending beyond the first end of the second leg portion, wherein said another finger can pivot relative to the web.

19. A slide member as recited in claim 18 wherein said finger and said another finger are spaced apart from each other and wherein said finger is proximate the first leg portion and wherein said another finger is proximate the second leg portion.

20. A slide member as recited in claim 19 wherein said finger and said another finger extend from a body coupled to the slide member.

21. A slide member as recited in claim 20 wherein said finger and said another finger are integral with the body and can flex relative to the body for pivoting relative to the web.

22. A slide member as recited in claim 20 wherein said finger and said another finger are pivotally coupled to the body.

23. A slide assembly comprising:

a first slide member having a first end opposite a second end;

a second slide member, slidably coupled to the first slide member, the second slide member being extendible along a path from the first end of the first slide member between a first non-extended position and a second extended position relative to the first slide member;

a first finger coupled to the first slide member, the first finger extending beyond the first end of the first slide member when the second slide member is in the first position, wherein said first finger can pivot relative to the first slide member for blocking the path when the first second member is in the first position; and a second linger coupled to the first slide member and extending axially beyond the first end of the second slide member when the second slide member is in the first position and spaced apart from the first finger, wherein the second finger can pivot relative the first slide member for blocking the path when the second slide member is in the first position.

24. A slide assembly comprising:

a first slide member having a first end and a second end;

a second slide member slidably coupled to the first slide member, the second slide, the second slide member being extendible along a path from the first end of the first slide member between a first non-extended position and a second extended position relative to the first slide member;

an actuator coupled to a first end portion of the first slide member, the actuator comprising, a body; and a first finger integral with the body and extending beyond the first end of the first slide member when the second slide member is in the first position, wherein said first finger can flex to pivot relative to the first slide member for blocking the path when the first second member is in the first position.

25. A slide assembly comprising:

a first slide member having a first end and a second end;

a second slide member slidably coupled to the first slide member, the second slide, the second slide member being extendible along a path from the first end of the first slide member between a first non-extended position and a second extended position relative to the first slide member;

an actuator coupled to a first end portion of the first slide member, the actuator comprising, a first finger extending beyond the first end of the first slide member when the second slide member is in the first position, wherein said first finger can pivot relative to the first slide member for blocking, the path when the first second member is in the first position, and a second finger extending axially beyond the first end of the second slide member when the second slide member is in the first position and spaced apart from the first finger wherein the second finger can pivot relative the first slide member for blocking the path when the second slide member is in the first position.

* * * * *

UNITED STATES PATENT AND TRADEMARK OFFICE

CERTIFICATE OF CORRECTION

PATENT NO. : 6,550,876 B2
DATED : April 22, 2003
INVENTOR(S) : Arthur E. Lammens It is certified that error appears in the above-identified patent and that said Letters Patent is hereby corrected as shown below:

Column 12,
Line 11, delete the words "the second slide,"
Line 17, insert a -- , -- after the word "comprising"

Column 13,
Line 18, delete the word "linger" and insert -- finger --
Line 28, delete the first mention of the phrase "the second slide,"

Column 14,
Line 13, delete the first mention of the phrase "the second slide,"
Line 23, delete the "," after the word "blocking"

Signed and Sealed this

Nineteenth Day of October, 2004

JON W. DUDAS
*Director of the United States Patent and Trademark Office*